US006722417B2

(12) United States Patent
Ban et al.

(10) Patent No.: US 6,722,417 B2
(45) Date of Patent: Apr. 20, 2004

(54) DEOXIDATION CASTING, ALUMINIUM CASTING AND CASTING MACHINE

(75) Inventors: Keisuke Ban, Ueda (JP); Koichi Ogiwara, Ueda (JP)

(73) Assignee: Nissin Kogyo Co., Ltd., Nagano (JP)

( * ) Notice: Subject to any disclaimer, the term of this patent is extended or adjusted under 35 U.S.C. 154(b) by 8 days.

(21) Appl. No.: 09/828,875

(22) Filed: Apr. 10, 2001

(65) Prior Publication Data

US 2001/0027852 A1 Oct. 11, 2001

(30) Foreign Application Priority Data

Apr. 10, 2000 (JP) ..... 2000-108078
May 10, 2000 (JP) ..... 2000-137789

(51) Int. Cl.[7] ..... B22D 27/00
(52) U.S. Cl. ..... 164/56.1; 164/57.1
(58) Field of Search ..... 164/56.1, 55.1, 164/57.1; 427/255.23, 255.28

(56) References Cited

U.S. PATENT DOCUMENTS 2,770,860 A * 11/1956 Webbere ..... 164/68.1
2,865,736 A * 12/1958 Beaver, Jr. ..... 75/59
3,364,976 A * 1/1968 Reding et al. ..... 164/63
3,650,313 A * 3/1972 Balevski et al. ..... 164/55
3,900,305 A * 8/1975 DeLuca ..... 65/30
4,245,691 A * 1/1981 Mohla ..... 164/56.1
4,811,782 A * 3/1989 Sola ..... 164/495
4,871,008 A 10/1989 Dwivedi et al. ..... 164/6
5,934,355 A * 8/1999 Nakao et al. ..... 164/97
6,171,363 B1 * 1/2001 Shekhter et al. ..... 75/369

FOREIGN PATENT DOCUMENTS

JP 11-36975 * 2/1999 ..... F02F/1/00
JP 2000-280063 A 10/2000 ..... B22D/21/04

OTHER PUBLICATIONS

US 2002/0129918A1 Ban et al. (Sep. 19, 2002—10/097,483 filed Mar. 15, 2002).*
US 2002/0139505A1 Ban et al. (Oct. 3, 2002—10/105,377 filed Mar. 26, 2002).*
US 2002/0144799A1 Ban et al. (Oct. 10, 2002—10/115,141 filed Apr. 4, 2002).*
US 2002/0195221A1 Ban (Dec. 26, 2002—10/166,743 filed Jun. 12, 2002).*

* cited by examiner

*Primary Examiner*—M. Alexandra Elve
*Assistant Examiner*—Kevin P. Kerns
(74) *Attorney, Agent, or Firm*—Birch, Stewart, Kolasch & Birch, LLP

(57) ABSTRACT

The method of deoxidation casting is capable of deoxidizing the oxide film formed on the surface of the molten metal, improving wettability to inner faces of a cavity of a casting die, and casting high quality products with high casting efficiency. The method of deoxidation casting includes the steps of reacting a deoxidizing compound, which is made by reacting a metallic gas on a reactive gas, on a molten metal; and deoxidizing an oxide film on a surface of the molten metal.

23 Claims, 11 Drawing Sheets

DEOXIDATION CASTING, ALUMINIUM CASTING AND CASTING MACHINE

BACKGROUND OF THE INVENTION

The present invention relates to deoxidation casting, aluminum casting and a casting machine.

Many ways of casting, e.g., gravity casting, low pressure casting, die casting, squeeze casting, thixotropic casting, are known. In many ways of casting, a molten metal is poured into a cavity of a casting die to solidify and form the metal into a prescribed shape. The ways of casting are selected on the basis of a material of the molten metal and a product to be cast.

Many kinds of products are cast. In the case of casting a product having a complex shape or high performance, the cavity must be securely filled with the molten metal so as to form no casting defects, have a prescribed strength, prevent deformation, and have a good external shape.

Aluminum and aluminum alloys have been widely used as the material of the molten metal. In the aluminum casting, aluminum is apt to make an oxide film. Due to the oxide film formed on a surface of the molten aluminum, the surface tension of the molten metal is made greater, so that fluidity and a welding property of the molten metal is made lower and casting defects are sometimes caused. To solve these disadvantages, many improvements, e.g., lubricant, pouring manners, pouring speed, pouring pressure, have been studied.

For example, in gravity casting and low pressure casting methods, the falling temperature of the molten metal is slowed by painting heat-insulating releasing agent, adjusting an arrangement of a gate, etc., so that bad molten metal running, crinkles, cold shuts, etc., which are caused by forming the oxide film on the surface of the molten metal, can be restricted. In die casting, the molten metal is filled in a short time with high pressure by adjusting the pouring speed, the pouring pressure, the arrangement of the gate, etc. In squeeze casting, the pouring pressure is highly pressurized during a step of the gravity casting so as to break and fuse the oxide film.

However, the conventional ways of casting have disadvantages, and no perfect ways are known. Especially, the oxide film, which is made or formed when the molten metal touches the inner faces of the cavity of the casting die, forms crinkles and cold shuts in a surface of a product, and the oxide film causes unsatisfactory filling of the molten metal. In the case of casting parts of airplanes and vehicles, whose surface stress and broken portions seriously influence safety, etc., all cast products are examined by means of fluorescent flaw detection. Therefore, the manufacturing cost of the products is higher. Further, the quality and reliability of the products cannot be fixed.

The problems of the oxide film are caused not only in aluminum casting but also casting with other materials.

SUMMARY OF THE INVENTION

The present invention has been invented to solve the problems caused by the oxide film formed on the surface of the molten metal.

An object of the present invention is to provide a method of deoxidation casting, which is capable of preventing the oxide film from forming on the surface of the molten metal, improving wettability to the inner faces of a cavity of a casting die, and casting high quality products with high casting efficiency.

Another object is to provide a deoxidation casting machine for executing said method.

The method of deoxidation casting of the present invention comprises the steps of:

reacting a deoxidizing compound, which is made by reacting a metallic gas on a reactive gas, on a molten metal; and deoxidizing an oxide film on a surface of the molten metal.

A metal for the metallic gas may be selected on the basis of the molten metal. For example, magnesium nitride compound ($Mg_3N_2$) which is made by reacting a magnesium gas with a nitrogen gas, may be employed as an effective deoxidizing compound, which is capable of deoxidizing the oxide film formed on the surface of the molten metal. Magnesium is stable from room temperature to high temperature and capable of easily subliming. Therefore, magnesium can be properly used in the method. The magnesium nitride compound has a high deoxidizing property, so that the oxide film on the surface of the molten metal can be effectively deoxidized.

The deoxidation casting of the present invention relates to a method which is capable of deoxidizing the oxide film formed on the surface of the molten metal so as to make the pure molten metal. Therefore, in the case of casting with a molten metal on which the oxide film is apt to be formed, the method of the present invention is capable of effectively deoxidizing the oxide film and properly casting with the pure molten metal.

By deoxidizing the oxide film on the surface of the molten metal, the surface tension of the molten metal can be lower, fluidity of the molten metal can be higher and the wettability with respect to the inner faces of the cavity of the casting die can be higher. Since the pure molten metal touches the inner faces of the cavity, the molten metal can easily flow in the casting die, the molten metal running property can be improved and the molten metal can securely fill the cavity including minute spaces thereof.

In a conventional casting method, lubricant or heat-insulating releasing agent are used to warm a casting die and maintain the fluidity of a molten metal. In the present invention, the fluidity of the molten metal is made higher, so that no lubricant or no heat-insulating releasing agent are required. Therefore, preparation and adjustment of the casting die can be easily achieved, and casting efficiency can be made higher.

In the conventional casting method, the casting die is heated until reaching a high temperature so as to maintain the fluidity of the molten metal. The molten metal is poured into the heated casting die. The molten metal is solidified by cooling the casting die. On the other hand, in the present invention, the fluidity of the molten metal is very high, so the casting die need not be heated. Therefore, the molten metal can be solidified in a short time, the product can be quickly solidified, toughness of the product can be greater, deformation of the product, such as with sink mark, extension, can be prevented and the quality of the product can be higher. The casting die may be used at room temperature.

In conventional gravity casting, a feeding head is formed in a casting die, and the molten metal is introduced into a cavity, by its own weight, from the feeding head. In the present invention, the fluidity of the molten metal in the casting die is very high, so the capacity of the feeding head can be reduced. In a conventional die, the capacity of the feeding head is 50–60% of capacity of the die. In the present invention, since the fluidity of the molten metal can be higher, the capacity of the feeding head can be reduced to 10–20% of the capacity of the casting die. Therefore, the molten metal can be efficiently used, and the casting die can be made easily. By reducing the capacity of the feeding head, the solidification of the molten metal can be accelerated, so that a cycle time of casting can be shorter and the casting efficiency can be improved. Further, in the present invention, the product can be easily separated from the casting die, so that the product can be taken out quickly and the casting efficiency can be improved.

There are two ways of reacting the molten metal on the deoxidizing compound in the cavity of the casting die. One way comprises the steps of: making the deoxidizing compound outside of the casting die; introducing the deoxidizing compound into the cavity; and pouring the molten metal into the cavity. The other way comprises the steps of: making the deoxidizing compound in the cavity of the casting die; and pouring the molten metal into the cavity.

The deoxidizing compound is precipitated on the inner faces of the cavity so as to react the deoxidizing compound on the molten metal thereon. To effectively precipitate the deoxidizing compound on the inner faces of the cavity, a metallic gas, which is made by evaporating a metal for making the deoxidizing compound, and a reactive gas, e.g., nitrogen gas, are reacted.

The deoxidizing compound may be introduced into or made in the cavity, in which a non-oxygen atmosphere is produced, so as not to reduce the deoxidizing function of the deoxidizing compound. The non-oxygen atmosphere may be produced by decompressing the cavity, introducing an inert gas into the cavity to purge air therefrom, etc.

The method of the present invention can be properly applied to a casting, in which aluminum or aluminum alloy is used as the molten metal. In aluminum casting, a magnesium nitride compound, which is made by reacting a magnesium gas on a nitrogen gas, and the molten aluminum are reacted so as to easily deoxidize the oxide film formed on the surface of the molten aluminum. In the case of aluminum, the oxide film is apt to be formed on the surface of the molten metal. By deoxidizing the oxide film by the magnesium nitride compound, high quality products can be produced.

In aluminum casting too, there are two ways of reacting the molten metal on the deoxidizing compound in the cavity of the casting die. One way comprises the steps of: previously making the magnesium nitride compound by reacting the magnesium gas on the nitrogen gas; introducing the magnesium nitride compound into the cavity; and pouring the molten aluminum into the cavity. The other way comprises the steps of: respectively introducing the magnesium gas and the nitrogen gas into the cavity of the casting die so as to make the magnesium nitride compound; and pouring the molten aluminum into the cavity. The magnesium nitride compound, which is the deoxidizing compound, is precipitated on the inner faces of the cavity including a core, then the molten aluminum is poured therein. When the molten aluminum touches the inner faces of the cavity, on which the deoxidizing compound has been precipitated, oxygen is removed from the oxide film on the surface of the molten aluminum by the deoxidizing function of the deoxidizing compound, so that the surface of the molten aluminum can be pure aluminum.

The oxide film formed on the surface of the molten aluminum is removed by deoxidation when the molten aluminum touches the inner faces of the cavity, so that crinkles and surface defects, which are formed on the surface of the products, can be prevented. Especially, in the case of casting products having complex shapes, it was impossible to remove the surface defects. However, in the present invention, good products having no surface defects can be cast due to high wettability and a capillary phenomenon of the molten aluminum.

In the case of making the magnesium nitride compound in the cavity, firstly the magnesium gas is introduced into the cavity, then the nitrogen gas is introduced thereinto. Magnesium is heated in an inert gas, e.g., argon gas, or a deoxidizing gas, e.g., hydrogen, until the magnesium is sublimed, so that the magnesium gas is made. The magnesium gas is introduced into the cavity. The magnesium gas is introduced together with a non-oxidizing carrier gas. The pressure and amount of the carrier gas are properly adjusted. Preferably, the carrier gas is an inert gas, e.g., argon. Magnesium is sublimed at a temperature of 700–850° C., and the magnesium gas can be easily introduced into the cavity by the carrier gas.

When the magnesium gas is introduced into the cavity, the cavity is in the non-oxygen atmosphere. To produce the non-oxygen atmosphere, the cavity is previously decompressed or purged with the nitrogen gas, etc. Oxygen in the cavity can be removed, and the magnesium gas can be uniformly introduced into the cavity.

After the magnesium gas is introduced into the cavity, the nitrogen gas is introduced into the cavity so as to make the magnesium nitride compound. The magnesium nitride compound is mainly precipitated on the inner faces of the cavity as powders.

When the nitrogen gas is introduced into the cavity, the pressure and amount of flow of the nitrogen gas are properly adjusted. To easily react the nitrogen gas on the magnesium gas, the nitrogen gas may be preheated to warm the casting die. Reaction time may be 5–90 seconds. If the reaction time is too long, the temperature of the casting die falls, so proper reaction time is 15–60 seconds.

When the nitrogen gas is introduced into the cavity to make the magnesium nitride compound, it is important to prevent the magnesium nitride compound from reacting on the casting die. The molten metal directly touches the inner faces of the cavity, so a surface condition of the molten metal highly influences a surface condition of the product. Therefore, the deoxidizing function of the magnesium nitride compound must work on the inner faces of the cavity.

The inner faces of the cavity must not react on the magnesium nitride compound. If an oxygen radical, etc., which easily reacts on the magnesium nitride compound, exists on the inner faces of the cavity, the deoxidizing function is lost before pouring the molten metal into the cavity. Therefore, it is improper to coat the inner faces of the cavity with an oxide material, e.g., lubricant, or a releasing agent. The inner faces of the cavity may be coated with a non-oxide material, e.g., graphite. Further, metal surfaces may be exposed in the inner faces of the cavity without coating with lubricant, etc., and the exposed metal surfaces may be treated with heat or nitrided. While the magnesium nitride compound exists on the inner faces of the cavity, the molten aluminum is poured into the cavity, then the magnesium nitride compound on the inner faces of the cavity reacts on the molten metal, so that oxygen is removed from the oxide film and the oxide film is deoxidized. With this reaction, the wettability of the molten aluminum is made much greater, the fluidity on the inner faces of the cavity is made higher and the capillary phenomenon is made active. Since the surface of the molten metal is made of pure aluminum, the products have a good external shape having no crinkles and no surface defects.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 13:
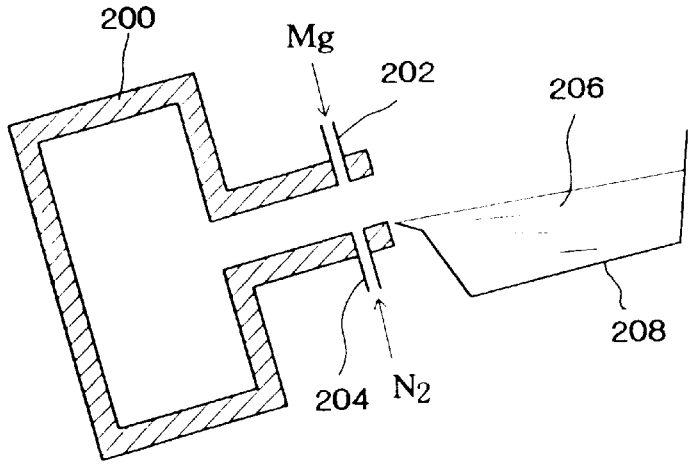
FIG. 13 is an explanation view of a manner of reacting a molten metal on a deoxidizing compound.

First, a basic theory of the present invention will be explained. A deoxidizing compound can be made to react with a molten metal in many ways. For example, the deoxidizing compound may be made to react on the molten metal at a pouring mouth of a casting die when the molten metal is poured therefrom, the deoxidizing compound may be made to react on the molten metal in a ladle, and the deoxidizing compound may be made to react on the molten metal in a reservoir, in which the molten metal is stored. In FIG. 13, inlets 202 and 204 are formed in the vicinity of the pouring mouth of the casting die 200. A magnesium gas and a nitrogen gas are respectively introduced into the pouring mouth so as to react the gasses on the molten metal 206, which is poured into the purring mouth. Magnesium nitride compound, which is the deoxidizing compound, is made in the pouring mouth, and the magnesium nitride compound can react on the molten metal 206. With this structure, the oxide film formed on the surface of the molten metal can be deoxidized when the molten metal is poured into the casting die, so that high quality products can be cast.

In FIG. 13, the molten metal is stored in a ladle 208. The oxide film on the surface of the molten metal may be deoxidized or removed by adding the deoxidizing compound into the molten metal in the ladle 208. Further, the deoxidizing compound may be added to the molten metal in a reservoir.

Figure 14:
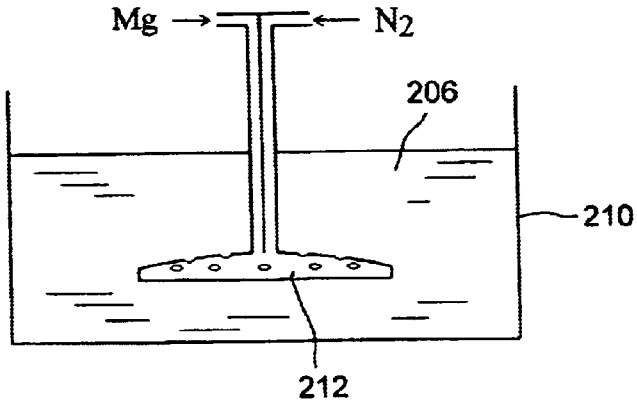
FIG. 14 is an explanation view of a manner of reacting a molten metal, which is stored in a reservoir.

FIG. 14 shows another example of reacting the deoxidizing compound on the molten metal. The molten metal 206 is stored in a reservoir 210. The deoxidizing compound is made in a bubbling member 212, whose lower end is dipped in the molten metal 206, and introduced into the molten metal 206. The deoxidizing compound is made by introducing the magnesium gas and the nitrogen gas into the bubbling member 212, so that the deoxidizing compound can be introduced into the molten metal 206 and the oxide film on the surface of the molten metal 206 can be deoxidized and removed. By removing the oxide film, the fluidity of the molten metal 206 can be higher, so that high quality products can be cast.

Figure 15:
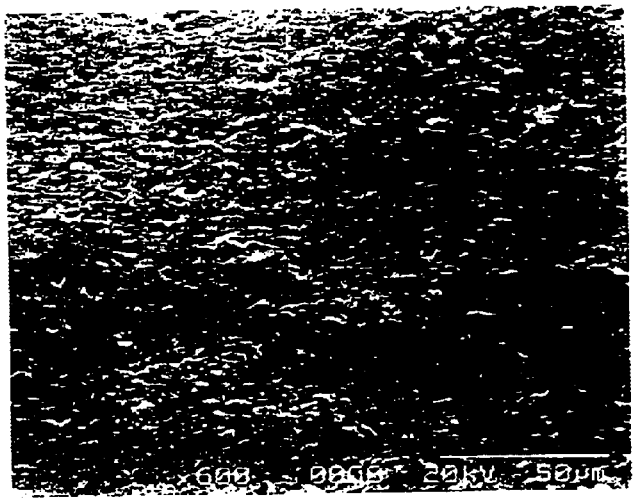
FIG. 15 is a microphotograph of a surface of a product, which is made by the method of the present invention.
Figure 16:
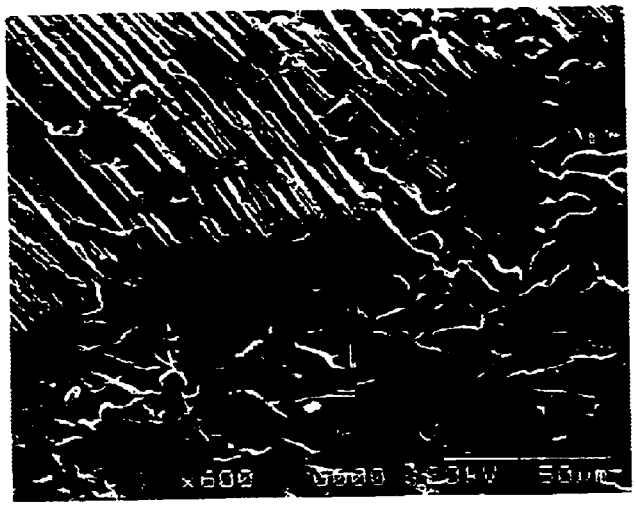
FIG.16 PRIOR ART
FIG. 16 is a microphotograph of a surface of a product, which is made by the conventional method.

FIG. 15 is a microphotograph of a surface of an aluminum product, which is cast by the method of the present invention; FIG. 16 is a microphotograph of a surface of an aluminum product cast by the conventional method. In FIG. 16, crinkles are observed on the surface of the product. On the other hand, in FIG. 15, the product is cast by the method of the present invention, and the product has a very smooth surface and no crinkles.

Next, some embodiments of the present invention will be explained with reference to FIGS. 1–5. In the embodiments, the magnesium gas and the nitrogen gas are respectively introduced into the cavity to make the deoxidizing compound, then the molten aluminum is poured into the cavity.

Figure 1:
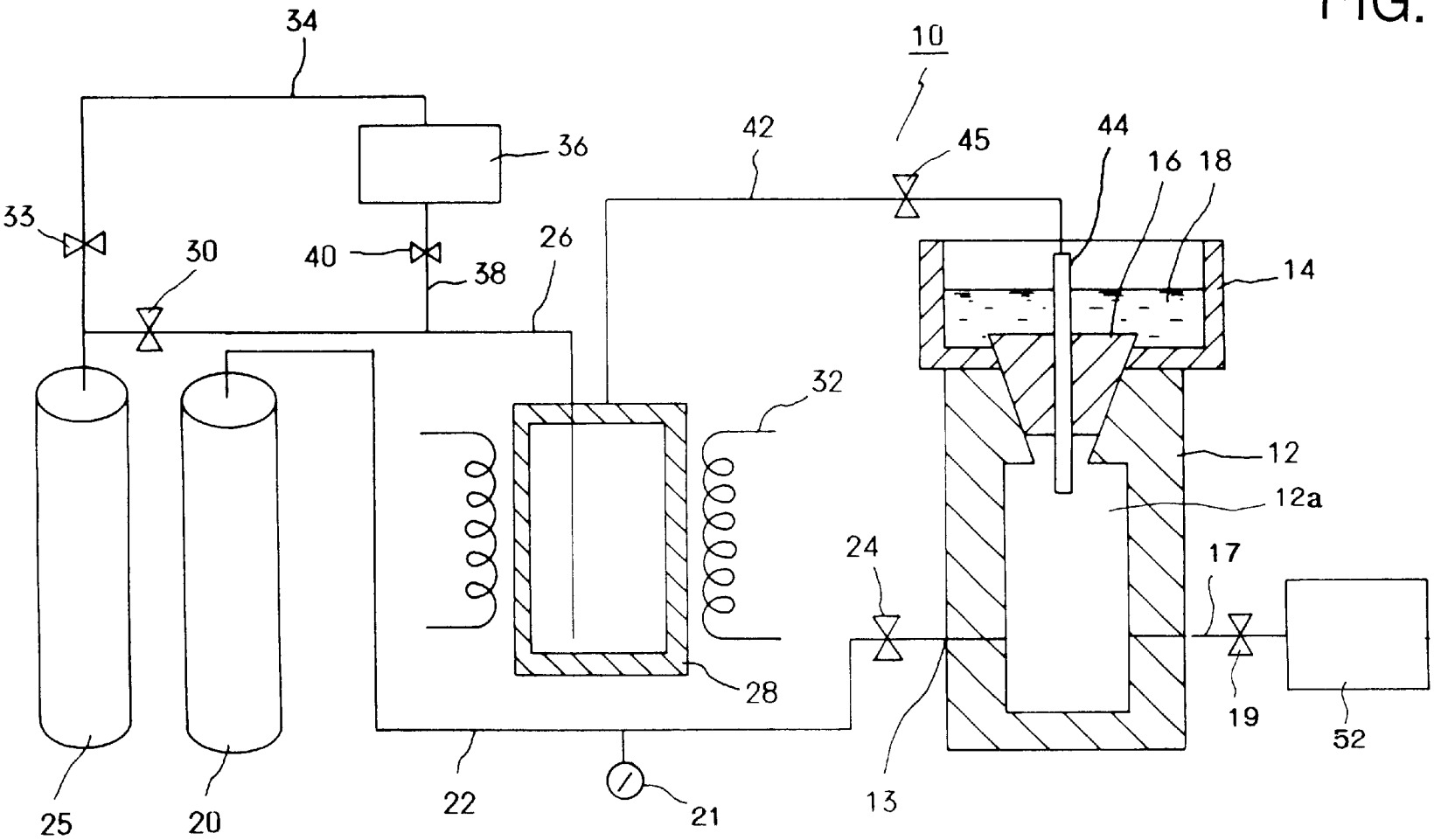
FIG. 1 is an explanation view of the deoxidation casting machine of a first embodiment of the present invention.

FIG. 1 shows an outline of a casting machine 10 of a first embodiment. A casting die 12 is connected to a reservoir 14. By moving a plug 16 upward, a prescribed amount of molten aluminum 18 is poured from the reservoir 14. Metal faces are exposed on the inner faces of a cavity 12*a*. A nitrogen cylinder 20 is communicated to the casting die 12 via a pipe 22. The nitrogen gas is introduced into the casting die by opening a valve 24 so as to discharge air in the casting die 12. An argon gas cylinder 25 is communicated to a furnace 28 via a pipe 26. An argon gas is introduced into the furnace 28 by opening a valve 30. Heaters 32 heat the furnace 28. The temperature in the furnace rises to 800° C. or more so as to sublime magnesium powders.

The argon gas cylinder 25 also communicates with a tank 36, in which the magnesium powders are stored, via a pipe 34, in which a valve 33 is provided. The tank 36 communicates with pipe 26 via a pipe 38, whose end is connected to the pipe 26 at a position under the valve 30. A valve 40 is provided in pipe 38. The furnace 28 communicates with the casting die 12 via a pipe 42 and a pipe 44, which is pierced through the plug 16. A valve 45 is provided in pipe 42.

Figure 2A:
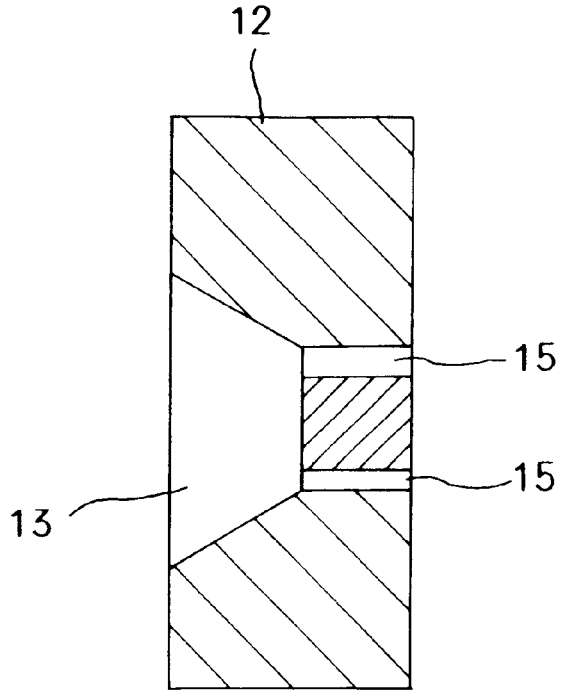
FIG. 2A is a sectional view of a connecting section of a casting die.
Figure 2B:
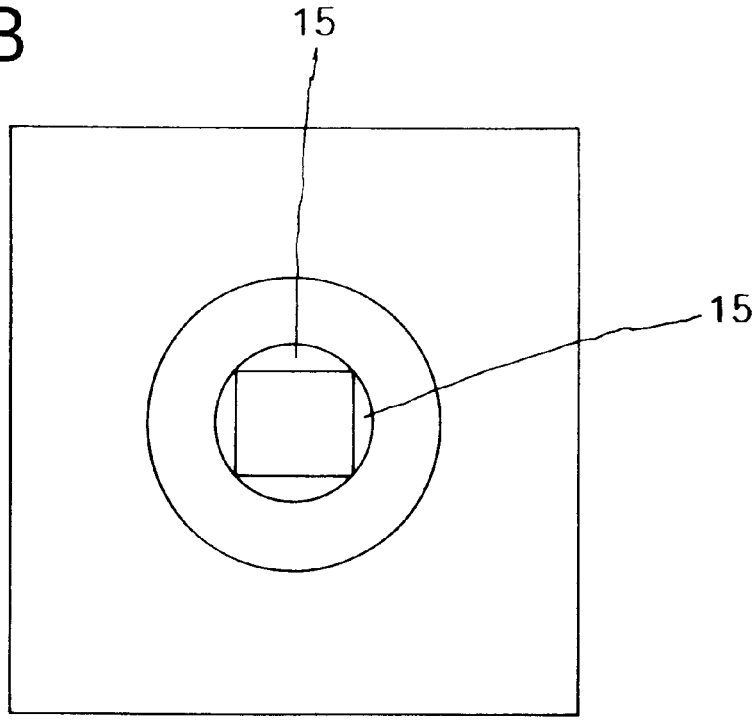
FIG. 2B is a front view of the connecting section.

FIGS. 2A and 2B show a connecting section 13 of the casting die 12, to which the pipe 22 is connected.

As shown in FIG. 2A, the connecting section 13 is formed into a female-tapered hole, whose inner diameter is gradually made greater toward the outside. A tapered connecting plug (not shown), which is provided to a front end of the pipe 22, is detachably connected to the connecting section 13. The connecting section 13 communicates with the cavity 12*a* via air ventilation holes 15.

The casting method executed by the casting machine 10 will be explained.

First, valve 24 is opened so as to introduce the nitrogen gas into the casting die 12 from the cylinder 20 via the pipe 22. By introducing the nitrogen gas, air in the casting die 12 can be purged or discharged. The air is discharged from air ventilation holes (not shown), which are formed in an upper part of the casting die 12, so that a non-oxygen atmosphere is produced in the casting die 12. After the air is purged from the casting die 12, valve 24 is closed. While the air is purged from the casting die 12, valve 30 is opened to introduce the argon gas into the furnace 28, so that a non-atmosphere is also produced in the furnace 28.

Next, valve 30 is closed and valve 40 is opened so as to supply the magnesium powders, which has been stored in the tank 36, into the furnace 28 by pressure of the argon gas. At that time, amount of flow and pressure of the argon gas may be adjusted by a flow adjuster. Since the furnace 28 is heated, by the heaters 32, to 800° C. or more so as to sublime the magnesium powders, the magnesium powders supplied are sublimed and the magnesium gas is generated.

Then, valve 40 is closed and valves 30 and 45 are opened so as to introduce the magnesium gas into the casting die 12 via pipes 42 and 44. At that time, the amount of flow and the pressure of the argon gas is adjusted. After the magnesium gas is introduced into the casting die 12, valve 45 is closed and valve 24 is opened so as to introduce the nitrogen gas into the casting die 12. By introducing the nitrogen gas into the casting die 12, the magnesium gas and the nitrogen gas react in the cavity 12*a* of the casting die 12, so that the magnesium nitride compound ($Mg_3N_2$) is made. The magnesium nitride compound is precipitated on the inner faces of the cavity 12*a* as powders.

In this state, plug 16 is moved upward to pour the molten metal 18, which has been stored in the reservoir 14, into the casting die 12. The molten aluminum 18, which has been poured into the casting die 12, reacts on the magnesium nitride compound, which has been precipitated on the inner faces of the cavity 12*a*. By the reaction, the magnesium nitride compound removes oxygen from the oxide film formed on the surface of the molten aluminum 18, so that the surface of the molten aluminum 18 is deoxidized and a pure aluminum surface is formed. Oxygen, which has been left on the casting die 12 or included in the molten aluminum 18, becomes magnesium oxide or magnesium hydroxide and will be involved in the molten aluminum 18. The amount of magnesium oxide or magnesium hydroxide is very small, so it does not badly influence the aluminum products.

Since the magnesium nitride compound, which has been precipitated on the inner faces of the cavity 12*a*, removes oxygen from the oxide film formed on the surface of the molten aluminum 18 and makes pure aluminum when the aluminum solidifies, the aluminum can be cast without forming an oxide film. The metal faces are exposed in the inner faces of the cavity 12*a*, so that the magnesium nitride compound can be held on the inner faces of the cavity 12*a* without loss and the molten metal can be deoxidized securely. Since the surface condition of the inner faces of the cavity 12*a* greatly influences an external shape of the product, the product can be cast with a good external shape because the magnesium-nitrogen compound can be securely made and held on the inner faces of the cavity 12*a*.

The magnesium-nitrogen compound prevents an oxide film from forming on the surface of the molten aluminum 18, so that the surface tension of the molten metal 18 can be small, and the wettability, fluidity, running property and smoothness of the molten metal 18 can be improved. Therefore, high quality aluminum products having no crinkles can be cast.

Note that, in the present embodiment, the nitrogen gas is introduced into the cavity 12*a* from the gas cylinder 20 so as to discharge the air in the cavity 12*a*. An inert gas, e.g., argon gas, may be used instead of the nitrogen gas so as to discharge the air. The air is discharged so as to prevent the magnesium nitride compound from reacting with oxygen in the cavity 12*a*.

To discharge the air from the cavity 12*a*, the nitrogen gas or the argon gas is introduced into the cavity 12*a*. Further, the cavity 12*a* may be decompressed by a decompression pump 52 so as to produce the non-oxygen atmosphere in the cavity 12*a*. In this case, valve 19 is opened to decompress the cavity 12*a* via the pipe 17, then valve 19 is closed and the magnesium gas is introduced into the cavity 12*a* (see FIG. 1).

When the nitrogen gas is introduced into the cavity 12*a* to make the magnesium nitride compound therein, the cavity 12*a* is pressurized by the argon gas, which acts as the carrier gas of the magnesium gas, and the nitrogen gas, which is supplied to make the magnesium nitride compound. But there are formed air ventilation holes, which discharge the air when the molten metal 18 is poured, in the casting die 12, so the pressure in the cavity 12*a* is gradually reduced after the molten metal 18 is poured. By reducing the pressure, fresh air is capable of invading into the cavity 12*a*. To prevent the air invasion, the valve 24 is opened to supply the nitrogen gas into the cavity 12*a* from the gas cylinder 20 while the molten metal 18 is poured. The amount of supplied nitrogen gas may be equal to the sum of the amount of the air discharged and the amount of nitrogen gas consumed to make the magnesium nitride compound. The amount of consumed nitrogen gas can be known based on the amount of the magnesium gas supplied to the cavity 12*a*. The amount of supplied nitrogen gas is controlled by a flow meter 21 and the valve 24, which are provided in the pipe 22.

In the above described embodiment, the method of the present invention is applied to gravity casting. The deoxidation casting method of the present invention is not limited to gravity casting.

Figure 3:
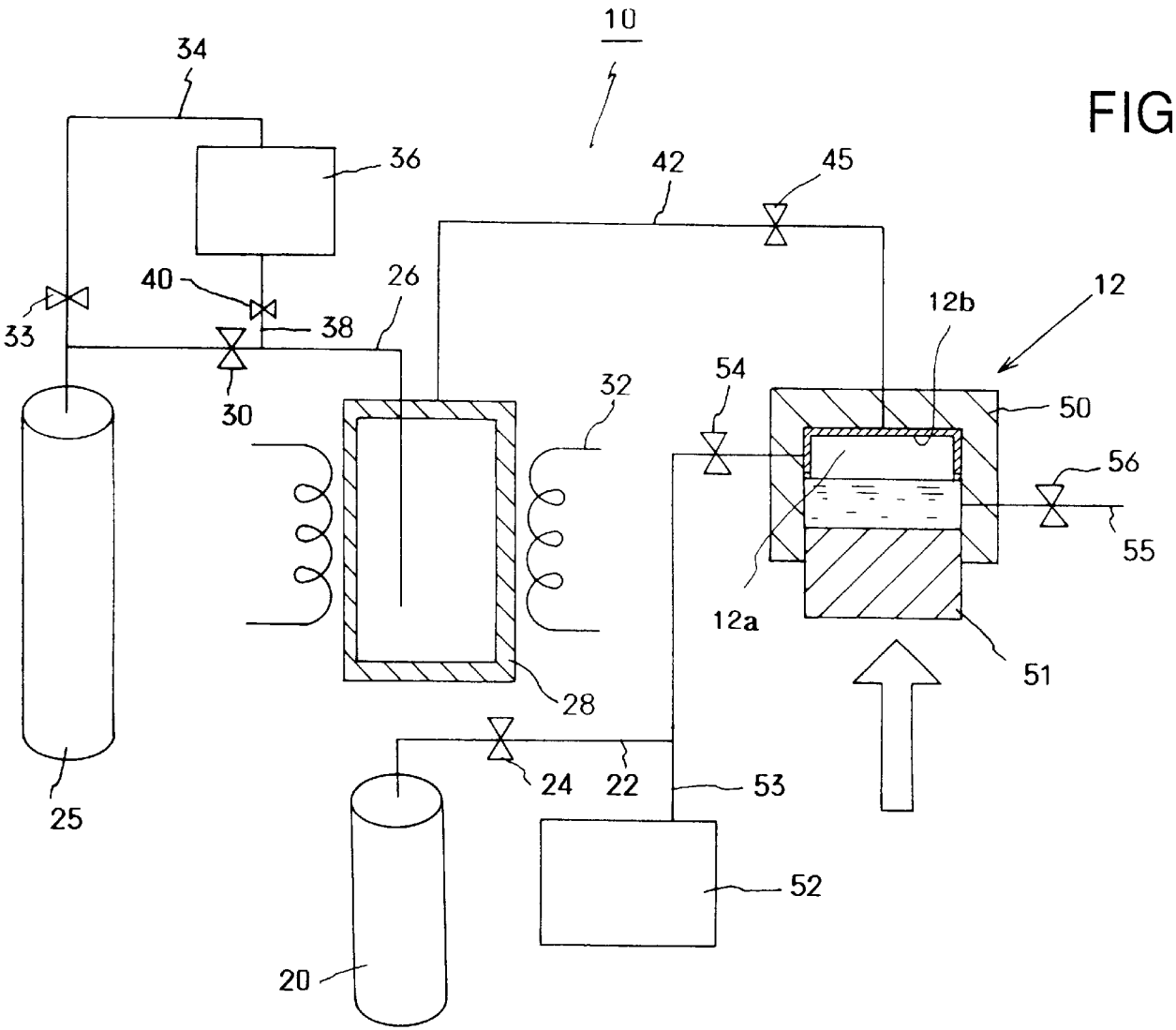
FIG. 3 is an explanation view of the deoxidation casting machine of a second embodiment of the present invention.

A second embodiment of the present invention will be explained with reference to FIG. 3. The casting die 12 is constituted by an upper die section 50 and a press die section 51. Namely, the method of the present invention is applied to high pressure casting. Unlike the casting die of the gravity casting explained in the first embodiment, the casting die 12 of the second embodiment has high airtightness.

In the second embodiment, a pipe 53 is branched from the pipe 22, which communicate the nitrogen gas cylinder 20 with the casting die 12, and communicated with the decompression pump 52. A valve 54 is provided to a mid portion of the pipe 22. The cavity 12*a* communicates with the outside by a pipe 55, and a valve 56 is provided to the pipe 55.

In the casting machine of the present embodiment, firstly the valves 24 and 56 are closed and valve 54 is opened, then the decompression pump 52 is driven to decompress the casting die 12 and produce the non-oxygen atmosphere therein. Simultaneously, argon gas is introduced into the furnace 28 from the cylinder 25, and valve 33 is opened to introduce the argon gas into the tank 36 so as to send the magnesium powder from the tank 36 to the furnace 28. The magnesium powder are sublimed in the furnace 28, and the magnesium gas is generated. In a state of closing valves 54 and 56, valve 45 is opened to introduce the magnesium gas into the casting die 12 together with the argon gas.

Next, the valve 54 is closed and valves 24 and 54 are opened to introduce the nitrogen gas into the casting die 12 from the cylinder 20. By introducing the nitrogen gas into the casting die 12, the magnesium gas and the nitrogen gas are mutually reacted, so that powders of the magnesium-nitrogen compound are precipitated on the inner faces of the cavity 12*a*.

In this state, the molten aluminum is cast in the cavity 12*a* by moving the press die section 51 upward. At that time, the inner faces of the cavity 12*a*, which is constituted by the inner faces of the upper die section 50 and the inner face of the press die section 51, are covered with the magnesium nitride compound, so that the oxide film on the molten aluminum 18 can be prevented while casting as in the first embodiment.

In the present embodiment, the inner faces of the cavity 12*a* are heat-treated to form triiron tetroxide. In FIG. 3, a symbol 12*b* stands for the heat-treated layer of triiron tetroxide. The layer of triiron tetroxide does not react on the magnesium nitride compound on the inner faces of the cavity 12*a*. Therefore, the deoxidizing function of the magnesium nitride compound can be maintained, so that the oxide film on the molten aluminum 18 can be effectively deoxidized. Besides the heat-treatment, the inner faces of the cavity 12*a* can be effectively treated by nitriding. When the molten metal 18 is poured and the press die section 51 pressurizes to cast, the valve 56 is opened to easily pour the molten aluminum 18.

Figure 4:
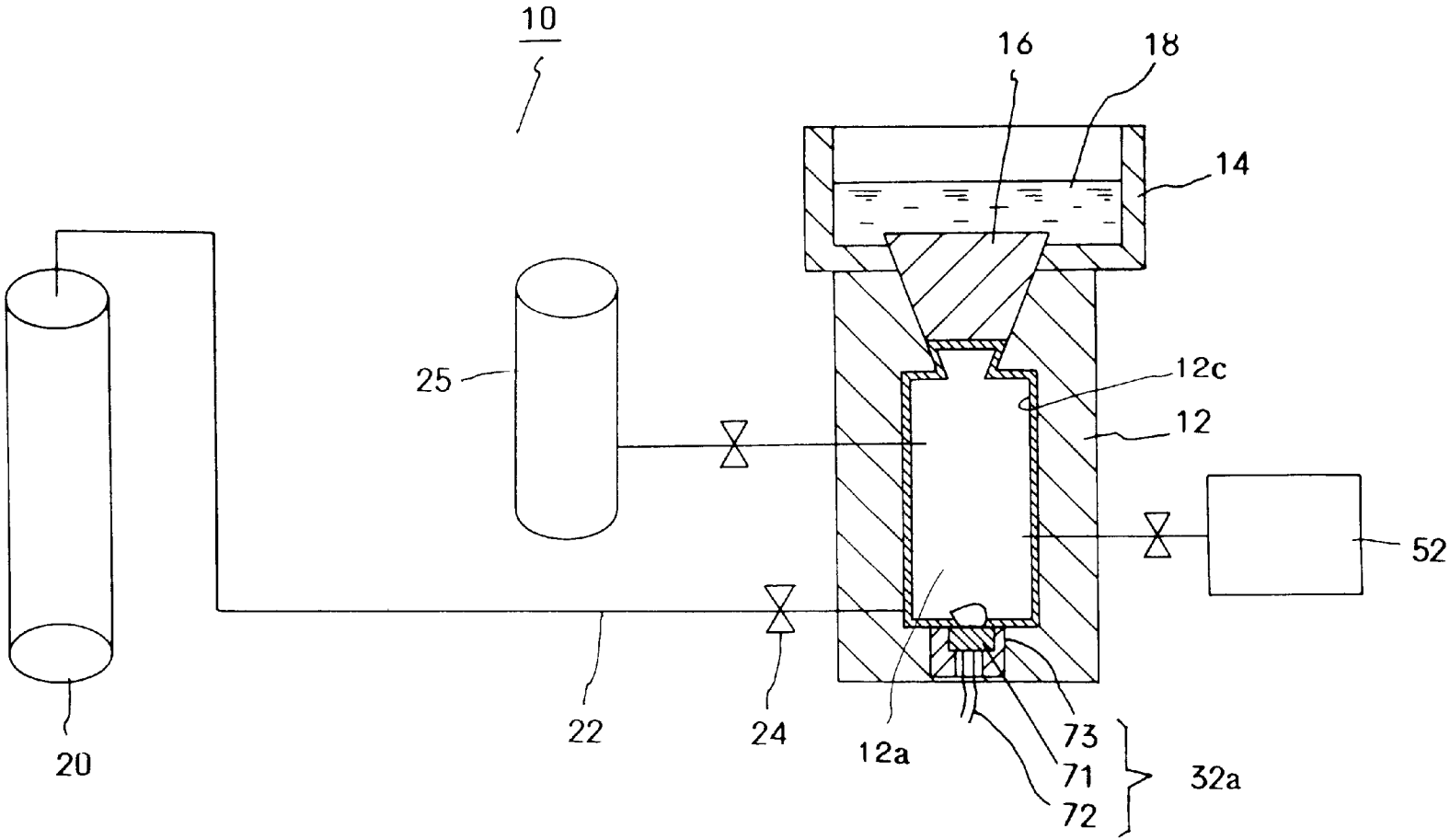
FIG. 4 is an explanation view of the deoxidation casting machine of a third embodiment of the present invention.

The casting machine 10 of a third embodiment will be explained with reference to FIG. 4. In the above described embodiments, the magnesium gas is made outside of the casting die 12. In the third embodiment, as shown in FIG. 4, a heater section 32*a*, which includes a heat conducting member 71, a heater 72 for heating the heat conducting member 71 and a heat insulator 73 for preventing heat conduction to the casting die 12 and maintaining the temperature of the heat conducting member to be 800° C. or more, is provided at a bottom part of the casting die 12. With this structure, the magnesium in the casting die 12 can be sublimed, and the magnesium gas can be generated therein.

In the present embodiment, the cavity 12*a* of the casting die 12 is decompressed by the decompression pump 52, or an inert gas, e.g., argon gas, is introduced into the cavity 12*a* so as to purge the air therefrom. Then, the magnesium is heated and sublimed in the cavity 12*a* of the casting die 12, and the nitrogen gas is introduced into the cavity 12*a* from the cylinder 20 so as to precipitate the magnesium nitride compound on the inner faces of the cavity 12*a*.

The inner faces of the cavity 12*a* are coated with a non-oxidizing material 12*c*. When the magnesium nitride compound is made, the non-oxidizing material 12*c* does not react on the magnesium nitride compound, so that the deoxidizing function of the magnesium nitride compound can be maintained. When the molten aluminum 18 is poured into the casting die 12, the oxide film formed on the surface of the molten aluminum 18 can be deoxidized and removed, so that the casting can be executed with pure aluminum. By casting with pure aluminum, high quality products, which have no crinkles and surface defects, can be cast.

Another example of the casting die 12, which has an inlet for the magnesium gas and an inlet for the nitrogen gas, will be explained with reference to FIG. 5. In the casting die 12, the plug 16 is attached in a sprue 11*a* and is capable of moving in the vertical direction. The sprue 11*a* communicates with cavity 12*a* via a pouring path 11*b*. The magnesium inlet 44*a* communicates with a mid portion of the pouring path 11*b* and connected to the pipe 42. The cavity 12*a* is formed between headers 23*a* and 23*b*, which are vertically arranged. The nitrogen inlet 22*a* and/or a decompression hole 17*a* is formed in the headers 23*a* and 23*b*. The headers 23*a* and 23*b* and the cavity 12*a* communicate via a communication path 15. Preferably, one of the magnesium inlet 44*a*, the nitrogen inlet 22*a* and the decompression hole 17*a* is used as an air ventilation hole, from which the air in the cavity 12*a* is discharged, when the molten metal 18 is poured into the cavity 12*a*.

In the casting die 12 of the present example also, the nitrogen gas is introduced into the cavity 12*a* via the nitrogen inlet 22*a* so as to purge the air from the cavity 12*a*, then the magnesium gas is introduced into the cavity 12*a* via the magnesium inlet 44*a* together with the argon carrier gas. Further, the nitrogen gas is introduced into the cavity 12*a* so as to make the magnesium nitride compound in the cavity 12*a*. In the case of previously decompressing the cavity 12*a*, the decompression may be executed via the decompression hole or holes 17*a*.

Figure 5:
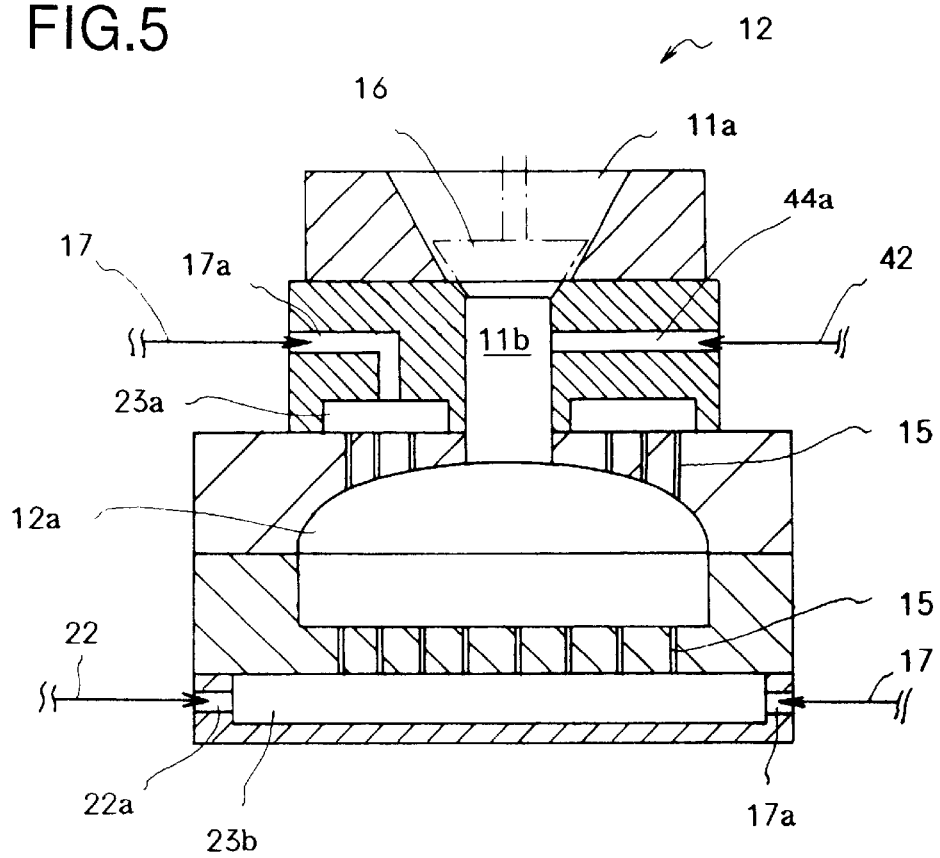
FIG. 5 is a sectional view of another example of the casting die.

As shown in FIG. 5, the magnesium gas and the nitrogen gas are introduced into the cavity 12*a* of the casting die 12 via different routes, so that deposits in the pipes 22 and 42 can be prevented, maintenance can be easy and casting efficiency can be improved.

Figure 6:
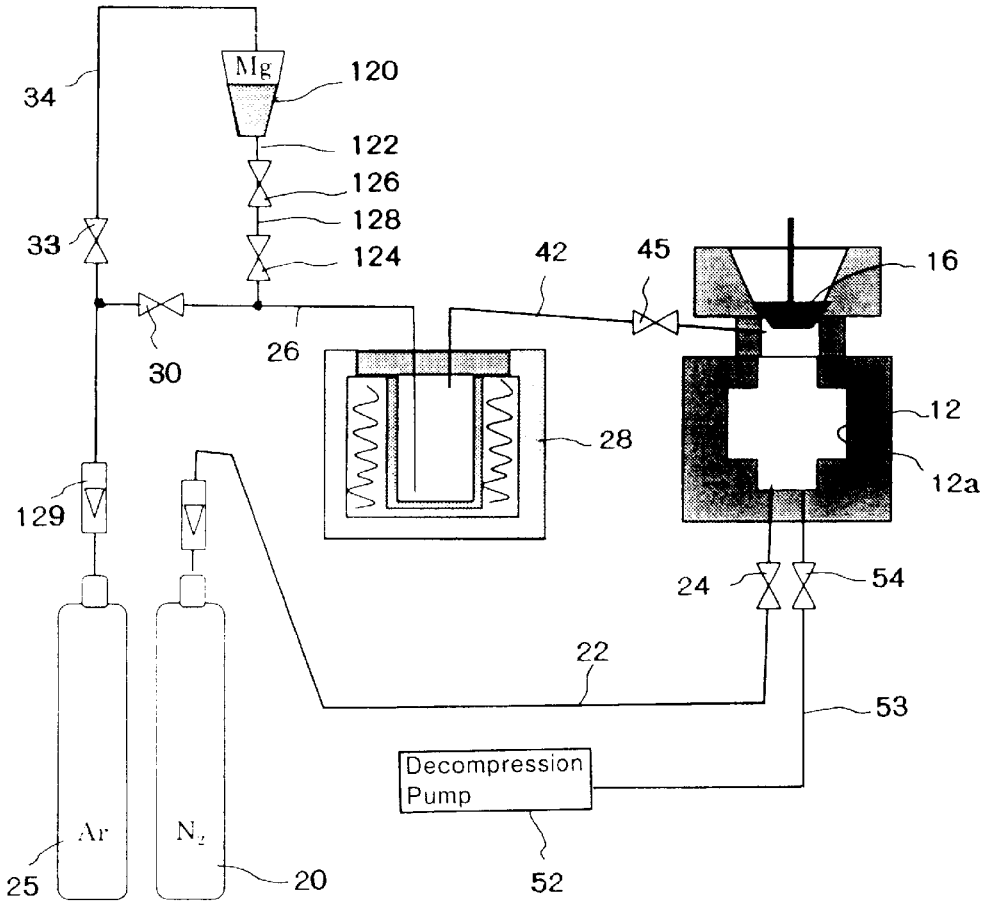
FIG. 6 is an explanation view of a magnesium feeding mechanism.
Figure 8:
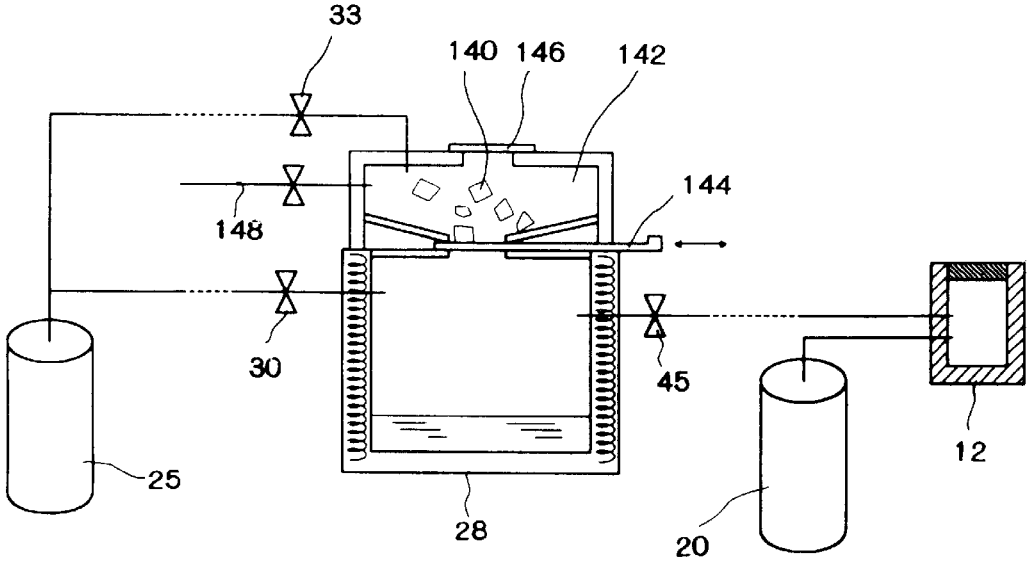
FIG. 8 is an explanation view of another example of the furnace.
Figure 7:
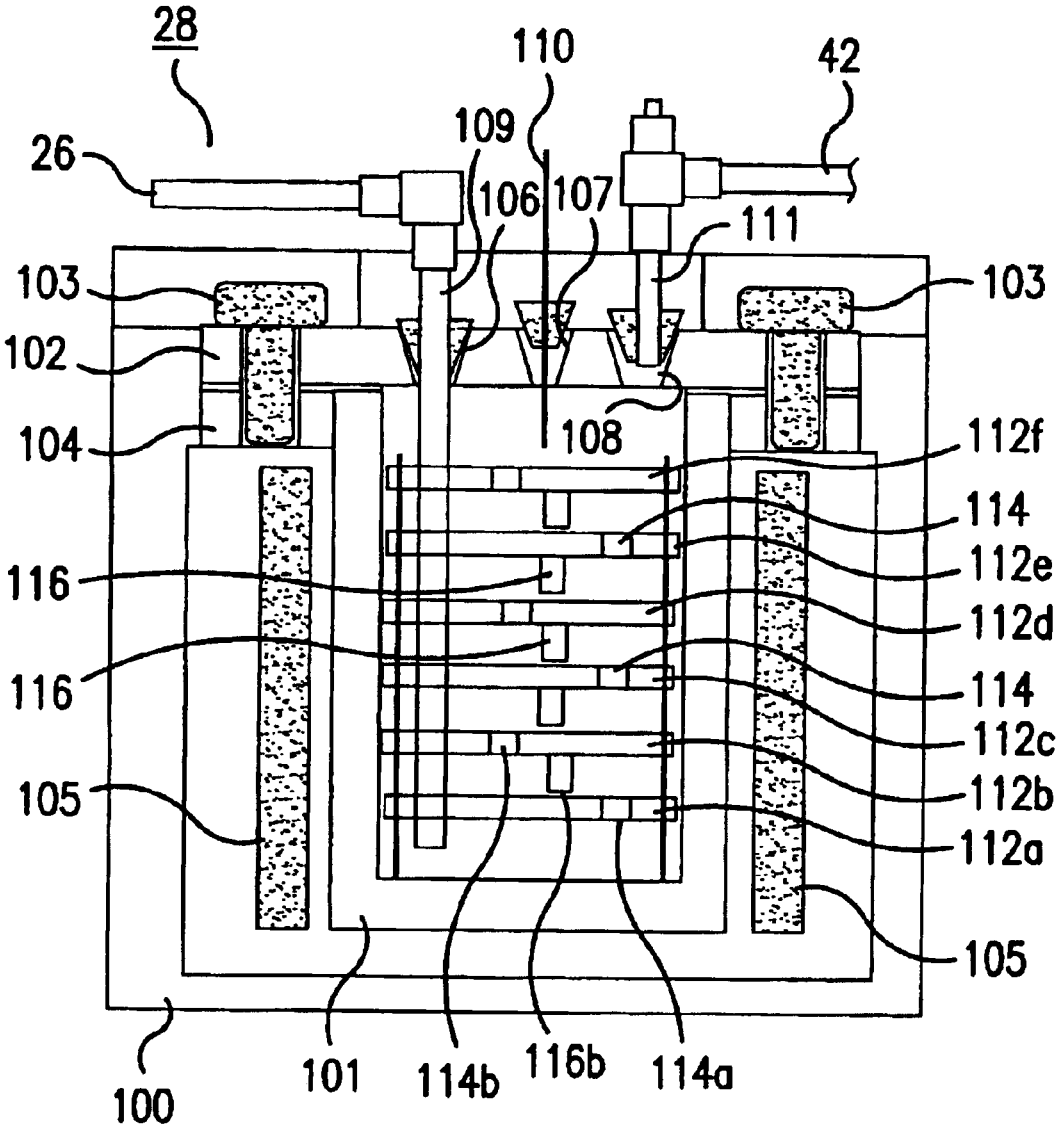
FIG. 7 is an explanation view of another example of a furnace.

FIGS. 6–8 show other examples, in which the metal, e.g., magnesium, is evaporated, and the evaporated metallic gas is introduced into the cavity of the casting die.

In FIG. 6, a fixed amount of the magnesium powders are supplied to the furnace 28. A tank 120, in which the magnesium powders are stored, is communicated to the furnace 28 via a pipe 122, valves 124 and 126 are provided in the pipe 122, and a fixed amount storing section 128 is provided between the valves 124 and 126. The fixed amount storing section 128 is formed in a cylindrical shape, and the amount of the magnesium stored therein can be controlled by adjusting the length and/or the inner diameter of the fixed amount storing section 128.

The magnesium is supplied from the fixed amount storing section 128 to the furnace 28. Firstly, valve 124 is closed and valve 126 is opened, and the argon gas is introduced into the tank 120 from the cylinder 25 so as to supply a fixed amount of the magnesium powders from the tank 120 to the fixed amount storing section 128. Then, valve 33 is closed and valves 30 and 124 are opened so as to introduce the magnesium powders into the furnace 28. At that time, the amount and pressure of the argon gas sent from the cylinder 25 are observed by a flow meter 129. With above described structure, the magnesium powders can be securely supplied to the furnace 28.

In FIG. 7, an outer casing 100 is constituted by a heat insulating material, and an upper face is opened. A furnace proper 101 of the furnace 28 is made of a heat-resisting material. A lid 102 covers the furnace proper 101, and the lid 102 is fixed to a flange section 104 by bolts 103. A heater 105 is provided in a space between the furnace 102 and the outer casing 100 so as to heat the furnace proper 101.

The lid 102 has three opening sections 106, 107 and 108, which communicate with to the furnace proper 101. An introducing pipe 109 is connected to a pipe 26, which communicates with tank 36. The introducing pipe 109 runs through the opening section 106 and goes into the furnace proper 101. A lower end of the introducing pipe 109 is opened near an inner bottom face of the furnace proper 101.

A thermocouple 110 runs through the opening section 107 and goes into the furnace proper 101. A discharge pipe 111 is connected to pipe 42, which communicates with the casting die 12, and runs through the opening section 108. A top end of the pipe 111 is located above the furnace proper 101 and opens in the air.

Six plates 112*a*–112*f*, which are made of a heat-resisting material, are arranged, in parallel with prescribed separations, in the vertical direction. The introducing pipe 109 is pierced through thorough-holes bored in the plates 112*a*–112*f*. The lower end of the introducing pipe 109 opens in a space between the inner bottom face of the furnace proper 101 and the lowest plate 112*a*.

A through-hole 114*a* is bored in the lowest plate 112*a* away from the introducing pipe 109. The plates 112*a*–112*f* respectively have through-holes 114*a*, 114*b* and 114, which are arranged zigzag in the vertical direction.

There is provided a partition 116*b* on a bottom face of the plate 112*b*. The partition 116*b* divides a space between the plates 112*a* and 112*b* into two parts: one part communicates with the through-hole 114*a*; the other part communicates with the through-hole 114*b*. Note that, a small gap is formed between a bottom face of the partition 116*b* and an upper face of the plate 112*a*. Therefore, the two parts mutually communicate via the small gap. Partitions 116 are respectively provided in spaces between the adjacent plates 112*b*–112*f*, and small gaps are also formed in the spaces as well.

The magnesium gas can be made in the furnace proper 101. First, the magnesium powders are supplied into the furnace proper 101 from the tank 36 by pressure of the argon gas via the pipes 26 and 109. Since the magnesium powders are very light, the magnesium powders are sprayed toward a lower part of the furnace proper 101 together with the argon gas and scattered therein. But an inner space of the furnace is formed into a zigzag space by the plates 112*a*–112*f*, so the magnesium powders are sublimed and the magnesium gas is made while the magnesium powders ascend in the zigzag space. It takes a prescribed time to perfectly sublime all magnesium powders. In the furnace 28, the inner space of the furnace proper 101 is vertically divided into a plurality of sub-spaces, and the magnesium powders are supplied, together with the argon gas, to the lowest sub-space of the furnace proper 101, so that scattering of the magnesium is limited and so that it takes a prescribed time for the magnesium powders to ascend. With this structure, the magnesium powders can be fully heated and perfectly sublimed, and no magnesium powders are supplied to the casting die 12 via the pipe 111. The magnesium gas in the furnace 28 may be supplied to the cavity 12*a* of the casting die together with the argon gas, which acts as the carrier gas.

In FIG. 8, magnesium pieces 140 are supplied to the furnace 28, and the magnesium pieces 140 are melted and evaporated therein, so that magnesium gas can be made and introduced into the cavity of the casting die 12. A gas lock chamber 142, which is airtightly closed and stores the magnesium pieces 140, is formed in an upper part of the furnace 28. A prescribed amount of the magnesium pieces 140 are supplied into the furnace 28. The magnesium pieces 140 are supplied into the furnace 28 from the gas lock chamber 142 by opening a shutter 144. The magnesium pieces 140 are melted in the furnace 28. After the prescribed amount of magnesium pieces 140 are supplied to the gas lock chamber 142, a lid 146 is closed and the argon gas is introduced into the gas lock chamber 142 from the cylinder 25. Then, air in the gas lock chamber 142 is discharged from a discharge pipe 148, so that a non-oxygen atmosphere can be produced in the gas lock chamber 142. The magnesium gas in the furnace 28 can be supplied to the cavity of the casting die 12 together with the argon gas, which is sent from the cylinder 25 and acts as the carrier gas.

Figure 10:
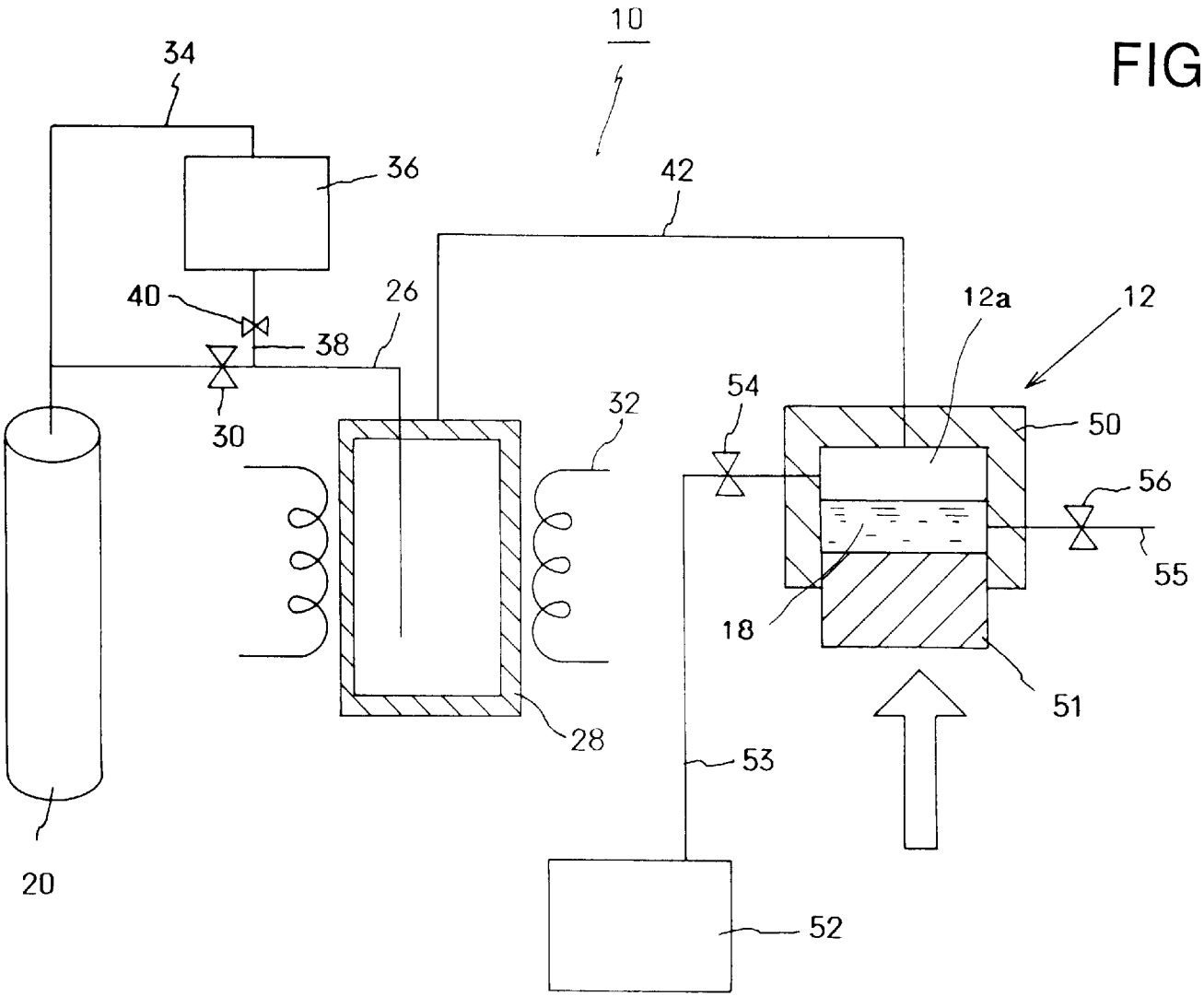
FIG. 10 is an explanation view of the deoxidation casting machine of a fifth embodiment of the present invention.
Figure 11:
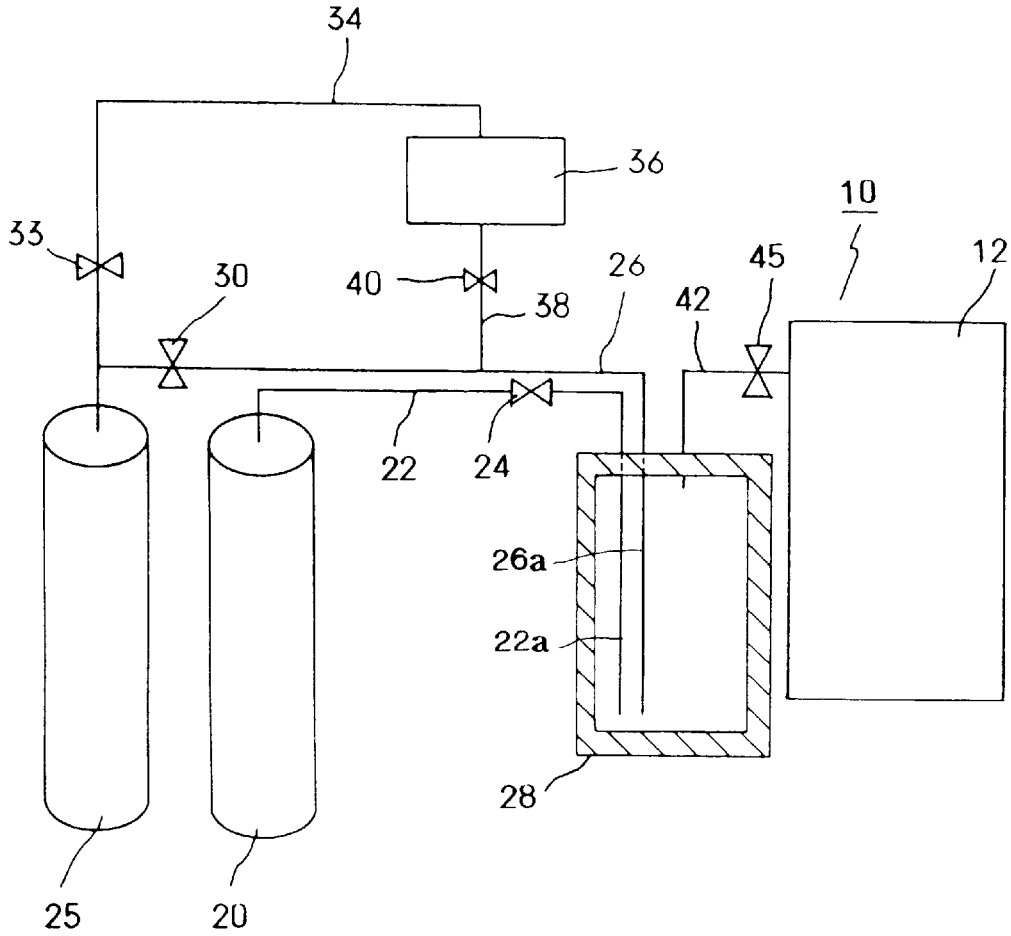
FIG. 11 is an explanation view of the deoxidation casting machine of a sixth embodiment of the present invention.

The fourth to sixth embodiments, in each of which the magnesium gas and the nitrogen gas are previously reacted outside of the casting die 12 to make the magnesium nitride compound ($Mg_3N_2$) and the magnesium nitride compound is introduced into the cavity before the pouring of the molten metal into the cavity, will be explained with reference to FIGS. 9–11.

Figure 9:
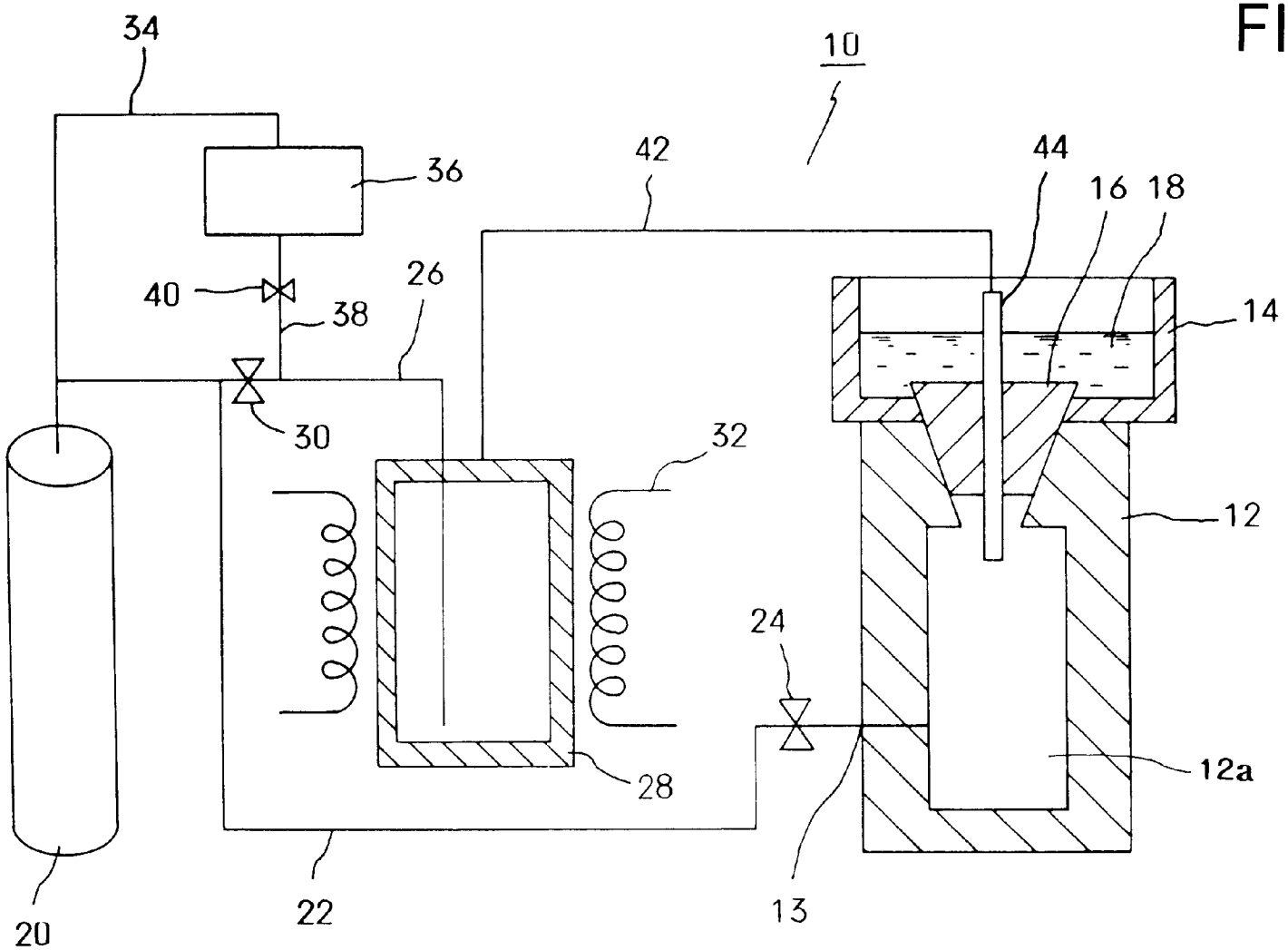
FIG. 9 is an explanation view of the deoxidation casting machine of a fourth embodiment of the present invention.

The casting machine 10 of the fourth embodiment is shown in FIG. 9. The casting die 12 communicates with the reservoir 14, in which the molten metal 18 is stored. By moving the plug 16 upwardly, a prescribed amount of the molten aluminum 18 is poured into the casting die 12. The nitrogen gas cylinder 20 is connected to the casting die 12 via the pipe 22. The nitrogen gas is introduced into the casting die 12 by opening the valve 24, so that air in the casting die 12 is purged. The gas cylinder 20 is connected to the furnace 28 via the pipe 26, so the nitrogen gas is introduced into the furnace 28 by opening the valve 30. The heater 32 heats the furnace until reaching a temperature of 800° C. or more so as to sublime the magnesium powders. The gas cylinder 20 is connected to the tank 36, in which the magnesium powders are stored, via the pipe 34. The tank 36 is connected to a part of the pipe 26, which is located on the furnace 28 side of the valve 30, by the pipe 38. The valve 40 is provided in the pipe 38. The furnace 28 communicates with the casting die 12 via the pipe 42 and the pipe 44, which is pierced through the plug 16 and projected into the casting die 12. The structure of the connecting section 13, which connects the pipe 22 to the casting die 12, is equal to that of the first embodiment shown in FIG. 2.

The method of deoxidation casting executed in the casting machine 10 will be explained.

First, the valve 24 is opened to introduce the nitrogen gas into the casting die 12 from the cylinder 20 via the pipe 22 until the casting die 12 is fully filled with the nitrogen gas. Air in the casting die 12 is purged and discharged outside via air ventilation holes (not shown). Then, the valve 30 is opened to introduce the nitrogen gas into the furnace 28.

Next, the valves 24 and 30 are closed, and a connecting plug of the pipe 22 is disconnected from the connecting section 13. The valve 40 is opened to introduce the magnesium powder into the furnace 28 from the tank 36 together with the nitrogen gas. The magnesium powder are sublimed in the furnace 28, and the magnesium gas reacts with the nitrogen gas, so that the magnesium nitride compound gas is introduced into the casting die 12 via pipes 42 and 44. The magnesium nitride compound precipitates on the inner faces of the cavity 12*a* of the cavity 12 as powders.

Then the plug 16 is moved upward, and the molten aluminum 18 is poured into the casting die 12. The molten aluminum 18 and the magnesium nitride compound react on the inner faces of the cavity 12*a* of the casting die 12, so that the magnesium nitride compound removes oxygen from the oxide film formed on the surface of the molten aluminum 18 and the molten aluminum 18 becomes pure aluminum. Some oxygen, which has been left in the cavity or been included in the molten aluminum 18, becomes magnesium oxide or magnesium hydroxide, but it remains in the molten aluminum 18. The amount of the magnesium oxide and the magnesium hydroxide are very small and they are chemically stable compounds, so they do not badly influence the aluminum products. An excess gas is discharged outside of the casting die 12 via the air ventilation holes (not shown).

As described above, the magnesium nitride compound removes oxygen from the oxide film formed on the surface of the molten aluminum 18, and oxygen, which was left in the cavity or been included in the molten aluminum 18, becomes magnesium oxide or the magnesium hydroxide and remains in the molten aluminum 18. Therefore, no oxide film is formed on the surface of the molten aluminum 18.

By forming no oxide film, the surface tension of the molten aluminum 18 is not made greater, the fluidity, the running property and the wettability of the molten aluminum 18 are improved, and high quality aluminum products having high smoothness can be cast.

The amount and density of the magnesium nitride compound in the casting die 12 is not restricted. Even if the density of the magnesium nitride compound is low, the nitrogen gas and the magnesium nitride compound fill the casting die 12, so that amount of the oxygen in the casting die 12 can be highly reduced and the formation of the oxide film can be highly prevented.

The nitrogen gas need not be previously introduced in the casting die 12. Namely, a mixed gas of the nitrogen gas and the magnesium nitride compound may be directly introduced into the casting die 12 to discharge the air therefrom.

In the fourth embodiment the deoxidation casting of the present invention is applied to gravity casting. The method of the present invention is not limited to the embodiment.

The fifth embodiment will be explained with reference to FIG. 10. The casting die 12 for the high pressure casting includes the upper die section 50 and the press die section 51. Unlike the casting die of the fourth embodiment shown in FIG. 9, the casting die 12 shown in FIG. 10 has higher airtightness. The cavity 12*a* of the casting die 12 communicates with the decompression pump 52 via the pipe 53 instead of connecting the pipe 22 (see FIG. 9) to introduce the nitrogen gas. The pipe 55 communicates the cavity 12*a* with the outside of the casting die 12. The valves 54 and 56 are respectively provided in pipes 52 and 55.

In the present embodiment, the valve 54 is opened and the valve 56 is closed to vacuum the air from the casting die 12 and produce the non-oxygen atmosphere therein before precipitating the magnesium nitride compound in the casting die 12. In this case too, deoxidation does not begin when the magnesium nitride compound is precipitated in the casting die 12, so the magnesium nitride compound can be efficiently used to deoxidize the oxide film formed on the surface of the molten metal 18. Note that, the valve 56 may be opened to easily pour the molten metal 18 into the casting die 12 when the molten metal 18 is poured and the high pressure casting is executed.

The sixth embodiment will be explained with reference to FIG. 11. The tank 36, in which the magnesium powders are stored, is connected to the furnace 28, and the nitrogen gas cylinder 20 and the argon gas cylinder 25 are connected to the furnace 28. The pipe 26, which is connected to the tank 36 and the cylinder 25, and the pipe 22, which is connected to the cylinder 20, are extended near the inner bottom face of the furnace 28. Parts 22*a* and 26*a* of the pipes 22 and 26 extend into the furnace 28. A lower end of the pipe 42, which connects the furnace 28 to the casting die 12, is opened in an upper part of the furnace 28.

In the sixth embodiment, firstly the valves 24 and 45 are opened so as to introduce the nitrogen gas into the furnace 28 and the casting die 12 via the pipes 22 and 42, so that the air in the furnace 28 and the casting die 12 are purged or discharged. Then, the valves 24 and 45 are closed. Note that, the air in the furnace 28 and the casting die 12 may be purged by opening the valve 30 and introducing the argon gas thereinto.

Next, the valve 30 is closed and the valves 33, 40 and 45 are opened so as to supply the magnesium powders, together with the argon gas, from the tank 36 to the furnace 28. Simultaneously, the valve 24 is opened to introduce the nitrogen gas into the furnace 28. The furnace 28 is heated to a temperature of 800° C. or more so as to sublime the magnesium powders. The magnesium powders introduced in the furnace 28 are sublimed and the magnesium gas is made, so that the magnesium gas reacts on the nitrogen gas and the magnesium nitride compound, which is an example of a deoxidizing compound, is made. The argon gas sends the magnesium nitride compound to the cavity of the casting die 12 as the carrier gas, and the magnesium nitride compound precipitates on the inner faces of the cavity as a powder.

While the magnesium nitride compound precipitates on the inner faces of the cavity, the molten aluminum is poured into the cavity. In the cavity, the molten aluminum reacts on the magnesium nitride compound on the inner faces of the cavity, so that the oxide film formed on the surface of the molten aluminum can be deoxidized while casting.

Figure 12:
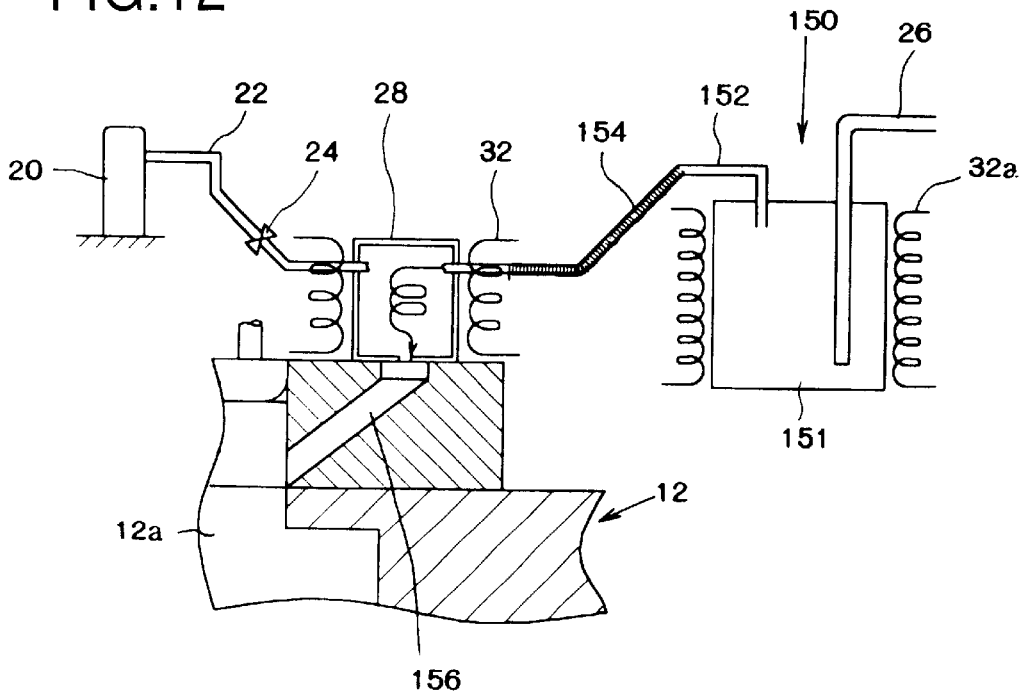
FIG. 12 is an explanation view of the deoxidation casting machine of a seventh embodiment of the present invention.

A seventh embodiment, in which a magnesium gas generating device is separated from a reaction chamber, e.g., the furnace 28, will be explained with reference to FIG. 12. A casing of a main part 151 of the magnesium gas generating device 150 is made of a heat insulating material. The main part 151 is heated, by the heater 32*a*, to a temperature of 800° C. or more. The pipe 26, which is connected to the tank, in which the magnesium powders are stored, and the argon gas tank is connected to the main part 151. The main part 151 is connected to the furnace 28 by a pipe 152. The nitrogen gas cylinder 20 communicates with the furnace 28 via the pipe 22.

In the present embodiment, the magnesium powders are supplied to the magnesium gas generating device 150, by the argon gas, via the pipe 26. The magnesium powders supplied are heated and sublimed, so that magnesium gas is generated. The magnesium gas is introduced into the furnace 28 via the pipe 152. Preferably, the pipe 152 is heated by a heater 154 to maintain the temperature of the magnesium gas.

The nitrogen gas is introduced into the furnace 28 via the pipe 22. The pipes 152 and 22 are opened and faced each other in the furnace 28, so that the magnesium gas and the nitrogen gas collide in the furnace 28. By introducing the magnesium gas and the nitrogen gas into the furnace 28, the both gasses react, and the magnesium nitride compound (the deoxidizing compound) is made.

The high temperature of the furnace 28 is maintained by the heater 32, so the reaction of the both gasses is accelerated, and the active deoxidizing compound is introduced into the cavity 12*a* of the casting die 12 at a high temperature. Therefore, the deoxidizing compound efficiently reacts on the molten metal. Preferably, the furnace 28 is provided on the casting die 12 to make a distance to the cavity 12*a* short. A communicating path 156 communicates the furnace 28 to the sprue of the casting die 12 or a part near the cavity 12*a*. Since the molten metal reacts on the deoxidizing compound immediately before the molten metal enters the cavity 12*a*, the fluidity of the molten metal in the cavity 12*a* can be improved, so that the molten metal can be effectively cast.

In the above described embodiments, pure aluminum is used as the molten metal, but other metallic materials, e.g., aluminum alloy including silicon, magnesium, copper, nickel, in, may be used as the casting metal. In the present invention, the word "aluminum" includes aluminum alloy.

Besides aluminum and aluminum alloys, other metals, e.g., magnesium, iron, and their alloys can be cast in the present invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of deoxidation casting, comprising the steps of:

reacting a metallic gas and a reactive gas to form a deoxidizing compound;

reacting the deoxidizing compound with a molten metal; and deoxidizing an oxide film on a surface of the molten metal;

wherein said deoxidizing compound reacts on the molten metal so as to deoxidize the oxide film on the surface of the molten metal as the molten metal is poured into a cavity.

2. The method of according to claim 1, wherein the molten metal is poured into the cavity of the casting die after a non-oxygen atmosphere is produced in the cavity.

3. The method according to claim 1, wherein the non-oxygen atmosphere is produced by decompressing the cavity of the casting die.

4. The method according to claim 1, wherein the non-oxygen atmosphere is produced by introducing an inert gas into the cavity of the casting die and purging air therefrom.

5. A method of deoxidation casting, comprising the steps of:

reacting a metallic gas and a reactive gas to form a deoxidizing compound;

reacting the deoxidizing compound with a molten metal; and deoxidizing an oxide film on a surface of the molten metal, wherein said deoxidizing compound is made by respectively introducing said metallic gas and said reactive gas to a cavity of a casting die and reacting said both gasses so that said deoxidizing compound is precipitated on an inner face of the cavity, and casting is executed by pouring said molten metal into the cavity.

6. The method according to claim 5, wherein the said metallic gas and said reactive gas are respectively introduced into the cavity via introducing holes, which are formed in the casting die and communicated to the cavity.

7. The method according to claim 5, wherein an inert gas is used, as a carrier gas, for introducing said metallic gas into the cavity of the casting die.

8. The method according to claim 5, wherein said metallic gas is introduced into the cavity of the casting die after a non-oxygen atmosphere is produced in the cavity.

9. The method according to claim 8, wherein the non-oxygen atmosphere is produced by decompressing the cavity of the casting die.

10. The method according to claim 8, wherein the non-oxygen atmosphere is produced by introducing an inert gas into the cavity of the die and purging air therefrom.

11. The method according to claim 5, wherein the cavity is pressurized by a gas, which reacts on said deoxidizing compound in the cavity, and the molten metal is poured into the pressurized cavity.

12. A method of deoxidation casting, comprising the steps of:

reacting a metallic gas and a reactive gas to form a deoxidizing compound;

reacting the deoxidizing compound with a molten metal; and deoxidizing an oxide film on a surface of the molten metal, wherein said metallic gas and said reactive gas are reacted outside of the casting die so as to make said deoxidizing compound, and said deoxidizing compound is introduced into the cavity of the casting die, then the molten metal is poured into the cavity.

13. The method according to claim 12, wherein an inert gas introduces said deoxidizing compound into the cavity of the casting die as a carrier gas.

14. The method according to claim 12, wherein a non-oxygen atmosphere is produced in the cavity, then said deoxidizing compound is introduced into the cavity.

15. The method according to claim 14, wherein the non-oxygen atmosphere is produced by decompressing the cavity of the casting die.

16. The method according to claim 14, wherein the non-oxygen atmosphere is produced by introducing an inert gas into the cavity and purging air therefrom.

17. The method according to claim 12, wherein the cavity is pressurized by a gas, which reacts on said deoxidizing compound in the cavity, and the molten metal is poured into the pressurized cavity.

18. A method of deoxidation casting, comprising the steps of:

reacting a magnesium nitride compound, which is made by reacting a magnesium gas with a nitrogen gas, on molten aluminum; and deoxidizing an oxide film on a surface of the molten aluminum, wherein said magnesium nitride compound is made by respectively introducing said magnesium gas and said nitrogen gas to a cavity of a casting die and reacting said both gasses so that said magnesium nitride compound is precipitated on an inner face of the cavity, and casting is executed by pouring said molten aluminum into the cavity.

19. The method according to claim 18, wherein an argon gas is used, as a carrier gas, for introducing said magnesium gas into the cavity of the casting die.

20. A method of deoxidation casting, comprising the steps of:

reacting a magnesium nitride compound, which is made by reacting a magnesium gas with a nitrogen gas, on molten aluminum; and deoxidizing an oxide film on a surface of the molten aluminum, wherein said magnesium gas and said nitrogen gas are reacted outside of the casting die so as to make said magnesium nitride compound, and said magnesium nitride compound is introduced into the cavity of the casting die, then the molten aluminum is poured into the cavity.

21. The method according to claim 20, wherein an argon gas is used, as a carrier gas, for introducing said magnesium gas into the cavity of the casting die.

22. A deoxidation casting machine, in which a magnesium nitride compound, which is made by reacting a magnesium gas on a nitrogen gas, is reacted with molten aluminum, and an oxide film on a surface of the molten aluminum is deoxidized by the magnesium nitride compound, comprising:

a casting die having a cavity, into which molten aluminum is poured so as to cast the aluminum into a prescribed shape;

means for introducing the nitrogen gas into the cavity;

a magnesium supply;

a furnace for generating the magnesium gas by heating and subliming magnesium; and means for introducing the magnesium gas from said furnace to the cavity of said casting die together with a carrier gas so as to make the magnesium nitride compound by reacting the magnesium gas on the nitrogen gas in the cavity so that said magnesium nitride compound is precipitated on an inner face of the cavity.

23. A deoxidation casting machine, in which a magnesium nitride compound, which is made by reacting a magnesium gas on a nitrogen gas, is reacted with molten aluminum, and an oxide film on a surface of the molten aluminum is deoxidized by the magnesium nitride compound, comprising:

a casting die having a cavity, into which molten aluminum is poured so as to cast the aluminum into a prescribed shape;

a reaction chamber being separated from said casting die;

a magnesium supply;

means for introducing the nitrogen gas and magnesium into said reaction chamber; and means for introducing the magnesium nitride compound, which is made in said reaction chamber by reacting the magnesium gas, which is generated by heating and subliming the magnesium, on the nitrogen gas, into the cavity together with a carrier gas.

* * * * *